US012685892B2

(12) United States Patent
Jorgensen

(10) Patent No.: US 12,685,892 B2
(45) Date of Patent: Jul. 21, 2026

(54) UNIVERSAL WORKOUT HANDLE WITH ADJUSTABLE HAND GRIP ORIENTATIONS

(71) Applicant: Kasper Overaa Jorgensen, Las Vegas, NV (US)

(72) Inventor: Kasper Overaa Jorgensen, Las Vegas, NV (US)

( * ) Notice: Subject to any disclaimer, the term of this patent is extended or adjusted under 35 U.S.C. 154(b) by 74 days.

(21) Appl. No.: 18/945,142

(22) Filed: Nov. 12, 2024

(65) Prior Publication Data

US 2025/0152995 A1 May 15, 2025

Related U.S. Application Data

(60) Provisional application No. 63/547,895, filed on Nov. 9, 2023.

(51) Int. Cl.
*A63B 21/00* (2006.01)

(52) U.S. Cl.
CPC ..... *A63B 21/4035* (2015.10)

(58) Field of Classification Search
CPC ..... A63B 21/4035; A63B 21/151; A63B 21/4043; A63B 23/1209; A63B 21/4033
USPC ..... 482/139; D21/692
See application file for complete search history.

(56) References Cited

U.S. PATENT DOCUMENTS

D918,319 S * 5/2021 Xu ..... D21/679
D970,659 S * 11/2022 Truong ..... D21/692
D972,055 S * 12/2022 Chen ..... D21/692
D1,081,859 S * 7/2025 Wilkins ..... D21/692
2008/0081750 A1* 4/2008 Arnett ..... A63B 23/12 482/139
2012/0329620 A1* 12/2012 White ..... A63B 23/1236 482/131
2013/0005544 A1* 1/2013 Butler ..... A63B 21/16 482/139
2013/0178345 A1* 7/2013 Wu ..... A63B 21/4043 482/139

(Continued)

FOREIGN PATENT DOCUMENTS

CN 114340743 A * 4/2022 ..... A63B 23/03516
WO WO-2020264135 A1 * 12/2020 ..... A63B 23/03516

*Primary Examiner* — Andrew S Lo
(74) *Attorney, Agent, or Firm* — Lee & Hayes, P.C.

(57) ABSTRACT

A universal workout handle with adjustable hand grip orientations is provided. In particular, the present disclosure provides an improved workout handle for cable machines used in weightlifting and strength training exercises. The handle features a primary metal ring that allows for easy attachment to a variety of cable machines, supporting compatibility across different equipment. A length of nylon strap is folded and sewn to create a secure loop through the metal ring, with two individual lengths extending below, each threaded through a hollow ergonomic hand grip. Positioned vertically along the straps, these hand grips allow for enhanced muscle control. The handle configuration is further adjustable through carabiner clips, enabling both vertical and horizontal orientations to accommodate exercises for all major upper body muscle groups without requiring attachment changes. This design provides users with flexibility to switch between tricep rope-style and stirrup handle configurations seamlessly, optimizing workout efficiency and minimizing interruptions.

10 Claims, 6 Drawing Sheets

(56) References Cited

U.S. PATENT DOCUMENTS

| | | | | |
|---|---|---|---|---|
| 2013/0196831 | A1* | 8/2013 | Kinsbourne | A63B 21/4043 482/92 |
| 2014/0162856 | A1* | 6/2014 | Kramer | A63B 21/0726 482/139 |
| 2014/0329650 | A1* | 11/2014 | Watry | A63B 69/0093 482/139 |
| 2015/0031512 | A1* | 1/2015 | Schleiden, II | A63B 21/0442 482/139 |
| 2017/0050074 | A1* | 2/2017 | Olson | A63B 21/4043 |
| 2018/0318631 | A1* | 11/2018 | Siu | A63B 21/0442 |
| 2020/0346062 | A1* | 11/2020 | Li | A63B 21/0552 |
| 2025/0352846 | A1* | 11/2025 | Puerta | A63B 21/4035 |

* cited by examiner

UNIVERSAL WORKOUT HANDLE WITH ADJUSTABLE HAND GRIP ORIENTATIONS

RELATED APPLICATION

This application claims priority to U.S. Provisional Application No. 63/547,895, filed Nov. 9, 2023, entitled UNIVERSAL WORKOUT HANDLE WITH ADJUSTABLE HAND GRIP ORIENTATIONS, by Kasper Overaa Jorgensen, the contents of which are incorporated herein by reference.

TECHNICAL FIELD

The present disclosure relates to the field of physical exercise equipment, and more particularly, to an improved workout handle of the type used to perform weight lifting exercises with a cable machine.

BACKGROUND

In the realm of fitness and weight lifting, the design of workout equipment has come a long way from its humble origins. One of the primary tools in this domain, cable weight lifting machines, has seen numerous attachments and accessories created to target specific muscle groups. However, a common drawback has been the need to repeatedly change these attachments to work on different areas of the upper body effectively.

Traditional handle attachments for cable machines include lat pulldown bars, straight bars, row attachments, stirrup handles, tricep rope attachments, and more. These serve to develop various upper body muscles, such as the forearms, biceps, triceps, and shoulders. While these attachments have their benefits, the inconvenience of swapping them out during a workout has long been a challenge. It would be desirable, therefore, to provide a workout handle attachment for cable machines that permits all the key muscle groups targeted by conventional cable machine attachments to be exercised without requiring users to interrupt their routines by switching handles.

SUMMARY

According to various embodiments herein, a universal workout handle with adjustable hand grip orientations is introduced. In particular, the present disclosure provides an improved workout handle that can be attached to a cable machine for weight lifting exercises. According to an illustrative embodiment herein, this versatile exercise accessory features a metal ring that easily attaches to cable machines, ensuring compatibility with a wide range of equipment. A length of nylon fabric (a strap, a band, a belt, webbing, rope, etc., collectively hereinafter referred to simply as a "strap") passes through this metal ring and is then folded on itself again and sewn together with durable nylon thread, creating a loop through which the length of strap hangs on the metal ring. Below the sewn portion of the strap, two lengths of folded strap are left unattached to each other, thus leaving two lengths of strap. A short distance below the sewn portion of the strap that secures it to the metal ring, there is another sewn portion on each individual length of strap, creating a loop through which a carabiner clip can be attached, allowing users to modify the orientation of the handles. Each length of strap, below the loop created by the second sewn area, passes through a hollow ergonomic hand grip, which is positioned vertically, in line with the strap's length. In one embodiment, this hand grip is composed of solid plastic, ensuring excellent muscle control during various upper body weightlifting exercises. On the far end of each hand grip is the remaining length of strap that has been threaded through the inside of the hand grip. A metal ring is attached to the end of this length of strap, below the hand grip, which acts as a stopper to prevent the hand grip from sliding down the entire length of strap. Below the metal ring is a second length of strap, which features a loop at the far end, furthest from the metal ring, designed for carabiner clip to be attached. This design enables users to exercise with a vertical handle orientation, akin to a standard tricep strap attachment, or to attach the carabiner clips to the loop at the top of the first length of strap above the hand grip to change the orientation of the ergonomic hand grip to a horizontal position, reminiscent of a stirrup handle.

This construction streamlines cable machine workouts, allowing users to target all major upper body muscle groups seamlessly without the inconvenience of changing attachments for different upper body exercises, enhancing the efficiency and user experience of weightlifting and strength training.

Additional features of the present invention are discussed in the detailed description of the preferred embodiment below, and shown in the drawings hereof, and this summary is not meant to limit the scope of the embodiments herein.

BRIEF DESCRIPTION OF THE DRA WINGS

The embodiments herein may be better understood by referring to the following description in conjunction with the accompanying drawings in which like reference numerals indicate identically or functionally similar elements, of which:

DETAILED DESCRIPTION

Figure 1A:
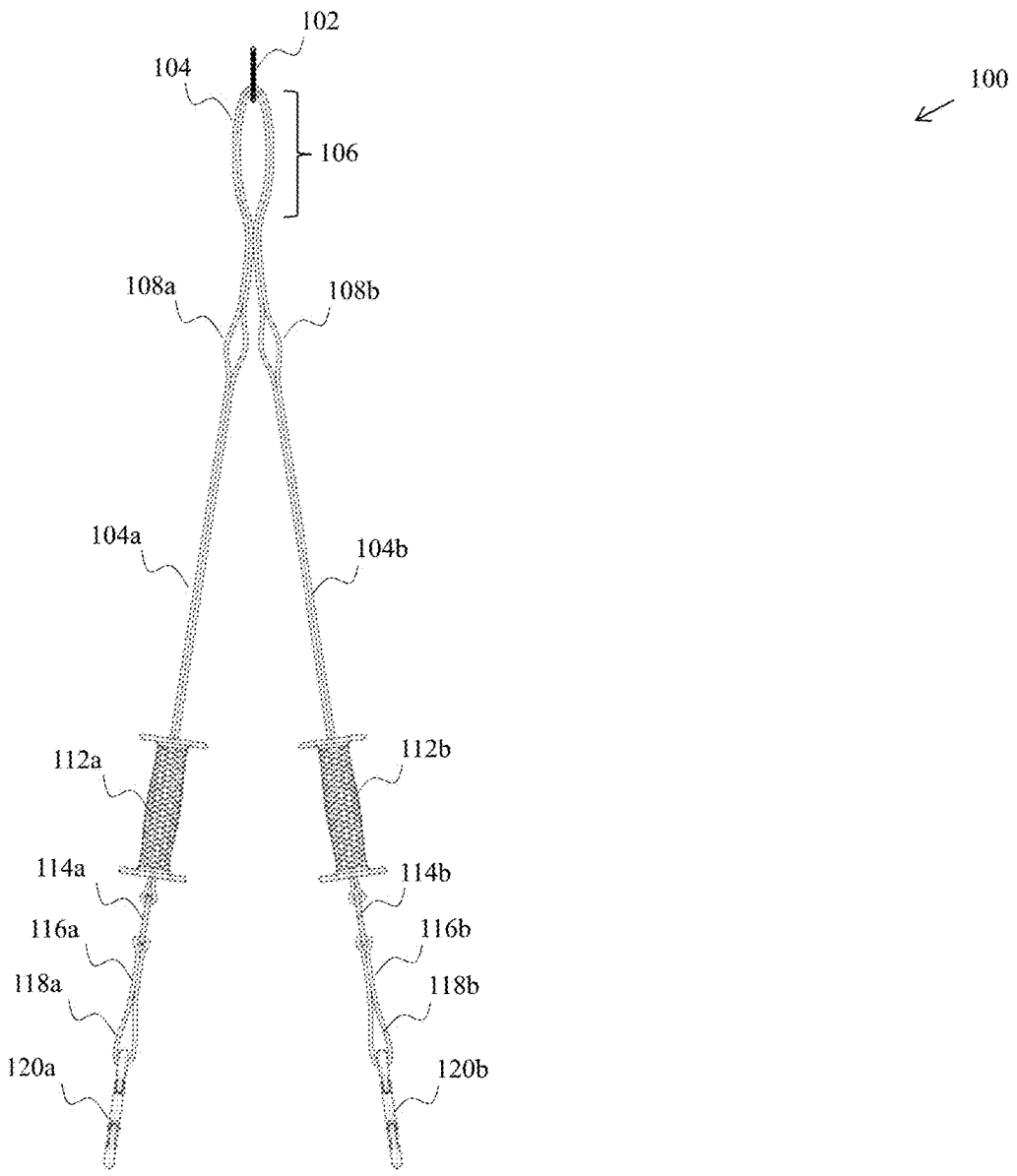
FIG. 1A illustrates a front view of an example embodiment of a universal workout handle with adjustable hand grip orientations according to the present disclosure.

The present disclosure introduces a universal workout handle with adjustable hand grip orientations specially designed to offer a solution to the need for constant cable machine attachment changes. Reference is made generally to FIGS. 1A-3, which illustrate examples of embodiments and uses of a universal workout handle, workout handle 100, with adjustable hand grip orientations according to the present disclosure.

In some embodiments, the improved workout handle consists of a metal ring 102 at the top, which seamlessly attaches to cable machines (not shown) in a manner similar to existing attachments, ensuring compatibility with virtually all cable machines. A length of nylon fabric (a strap, a band, a belt, etc., collectively hereinafter referred to simply as a "strap"), namely strap 104, that has been folded over itself once, thus doubling its thickness, passes through this metal ring 102 and is then folded on itself again and sewn together with nylon thread, creating a loop 106 through which the length of strap hangs on the metal ring 102. Below the sewn portion of the strap, two lengths of strap, portion 104*a* and portion 104*b*, respectively, are left unattached to each other, thus leaving two lengths of strap. A short distance below the sewn portion of the strap that secures it to the metal ring (loop 106), there is another sewn portion on each individual length of strap, creating another loop on each portion of strap, namely, loop 108*a* and loop 108*b*, through which a carabiner clip can be attached, allowing users to modify the orientation of the handles. Each length of strap, below the loop created by the second sewn area, passes through a hollow ergonomic hand grip, hand grip 112*a* and hand grip 112*b*, positioned vertically in line with the strap's length. These solid plastic hand grips offer superior muscle control, making them ideal for a variety of upper body weightlifting exercises. At the other end of each handle is the remainder of the first length of strap that has been threaded through the inside of the hand grip. A metal ring (metal ring 114*a* and 114*b*) is attached to the end of this length of strap (the end of portion 104*a* and portion 104*b*, respectively), below the hand grip (below hand grip 112*a* and hand grip 112*b*, respectively), which acts as a stopper to prevent the hand grip from sliding down the entire length of strap. Attached to this metal ring, below the hand grip, another length of fabric (strap) is attached, second strap 116*a* and second strap 116*b*, respectively. This second strap also features a loop at its end (loop 118*a* and loop 118*b*, respectively), through which a carabiner clip is attached (carabiner clip 120*a* and carabiner clip 120*b*, respectively).

The versatility of this workout handle is a highlight of this invention. As shown and described below, users can exercise in a vertical orientation similar to a standard tricep rope attachment. Alternatively, they can attach the carabiner clips at the end of each strap to the loop at the top of the first length of strap, directly below the metal ring and in between the two sewn portions, thereby changing the orientation of the ergonomic hand grip to a horizontal position reminiscent of a stirrup handle.

With this innovative design, the universal workout handle ensures that all major upper body muscle groups can be efficiently exercised without interruption, simplifying cable machine workouts, and enhancing the user experience. It is to be understood that the invention is not limited in its application to the details of construction and the arrangement of components described hereinafter and illustrated in the figures. Those skilled in the art will recognize that various modifications can be made without departing from the scope of the invention.

In greater detail, as shown in FIGS. 1A-1C and FIGS. 2A-2B, the workout handle 100 in its vertical orientation provides the user with the ability to exercise an array of arm and upper body muscles. As noted, the hand grips may be made of solid plastic, making them ideal for muscle isolation and control while performing the different types of upper body weightlifting exercises, though other suitable materials may be used, such as metals or structural composites. When using a traditional rope attachment on a cable machine, the user's hands are often rotated between a vertical and horizontal position to isolate different upper arm muscles. This results in pressure being put on a user's hands and wrists, often causing pain. The solid plastic hand grips in the present application are stiff and ergonomic, allowing the user to manipulate the orientation of the handle (horizontal, vertical), thus targeting specific arm and upper body muscles, without putting pressure on or causing pain to the user's hands and wrists.

Figure 3:
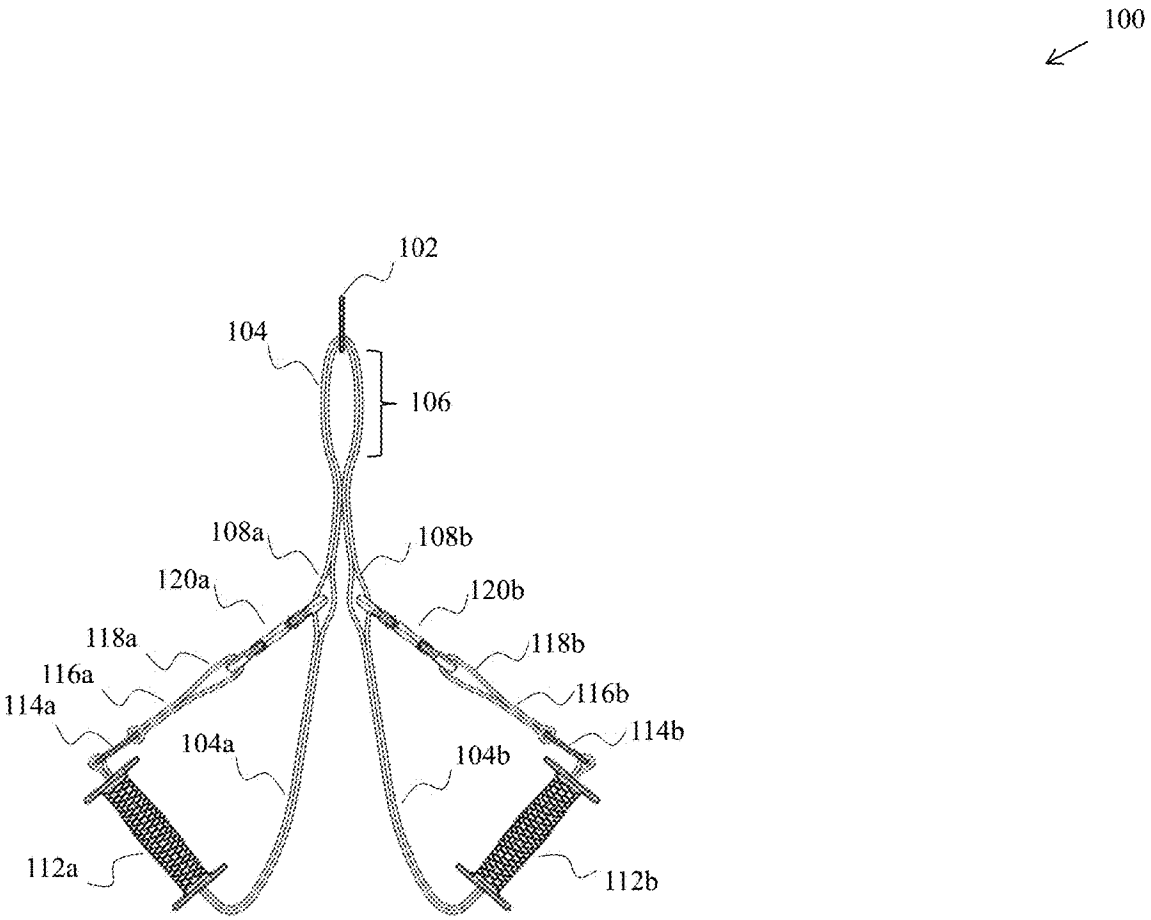
FIG. 3 illustrates an example view of the universal workout handle in a connected orientation according to the present disclosure

FIG. 3 shows the workout handle 100 in its horizontal orientation, where the carabiner clips (carabiner clip 120*a* and carabiner clip 120*b*) at the second lengths of strap below the hand grips are attached to the loops (namely, loop 108*a* and loop 108*b*, respectively) sewn into the top of the first lengths of strap above the hand grips and immediately below the metal ring 102 that attaches the entire apparatus to a cable machine (not shown). This configuration of the workout handle resembles a standard stirrup handle attachment, and allows users to exercise their shoulders, back, chest, biceps, triceps, and abs and perform numerous popular gym exercises, as will be appreciated by those skilled in the art.

Figure 1B:
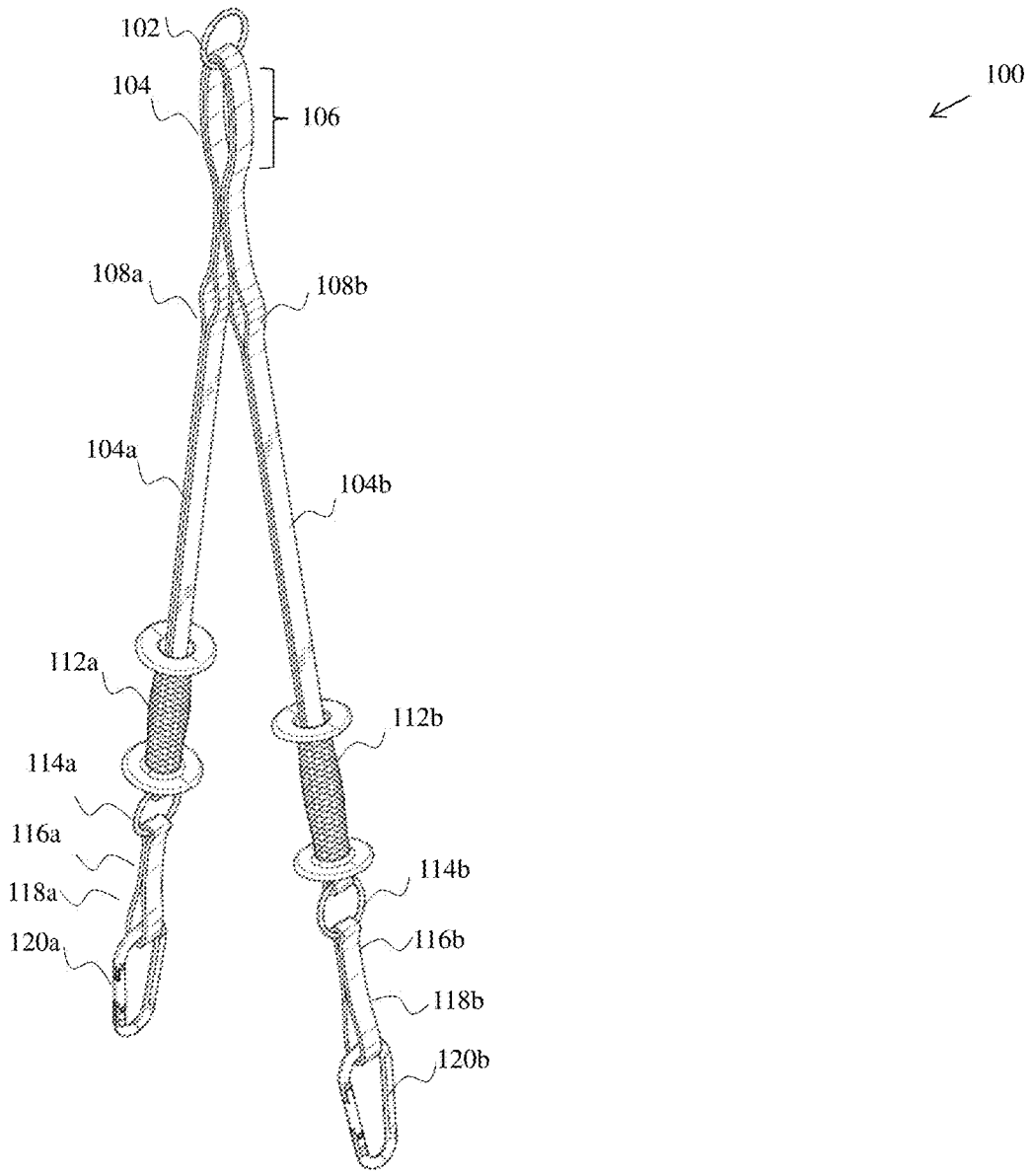
FIG. 1B illustrates an isometric view of an example embodiment of the universal workout handle with adjustable hand grip orientations according to the present disclosure.
Figure 1C:
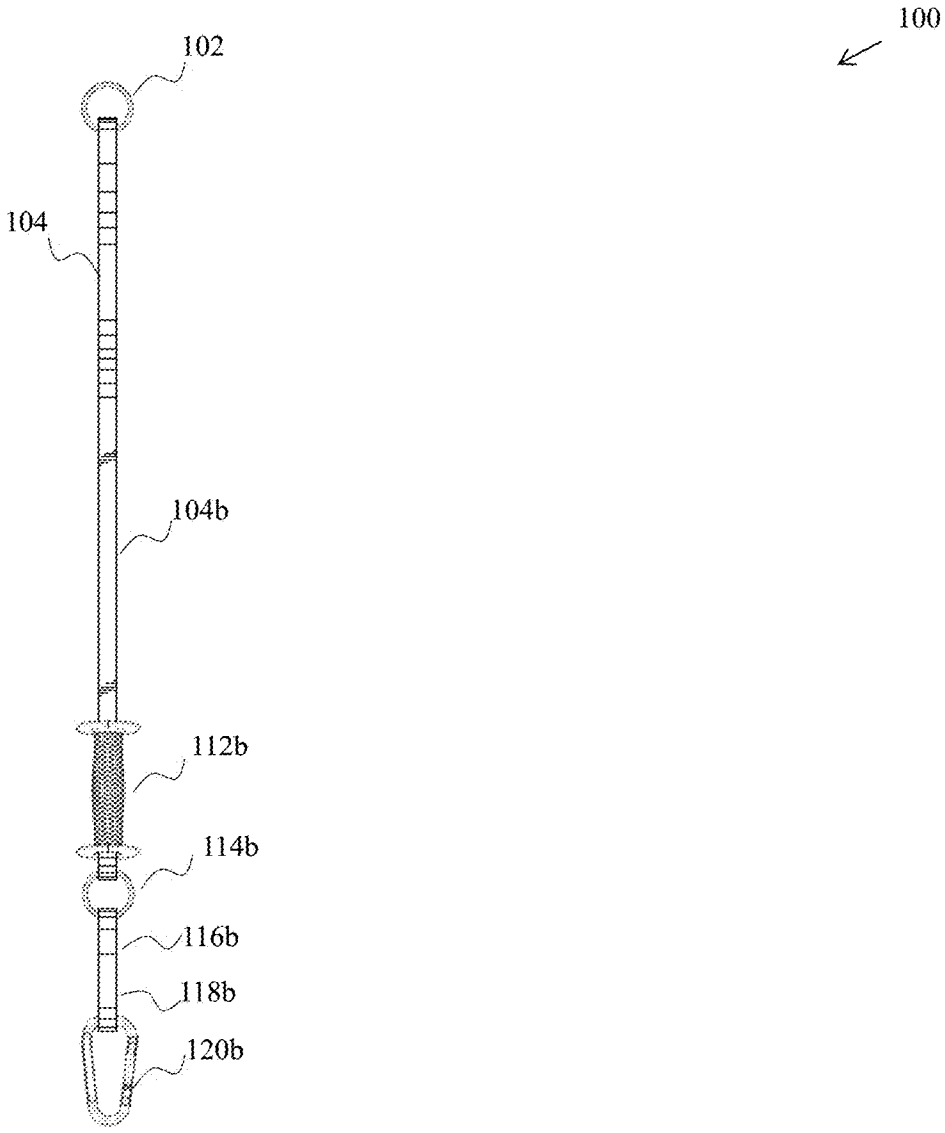
FIG. 1C illustrates a side view of an example embodiment of the universal workout handle with adjustable hand grip orientations according to the present disclosure.
Figure 2A:
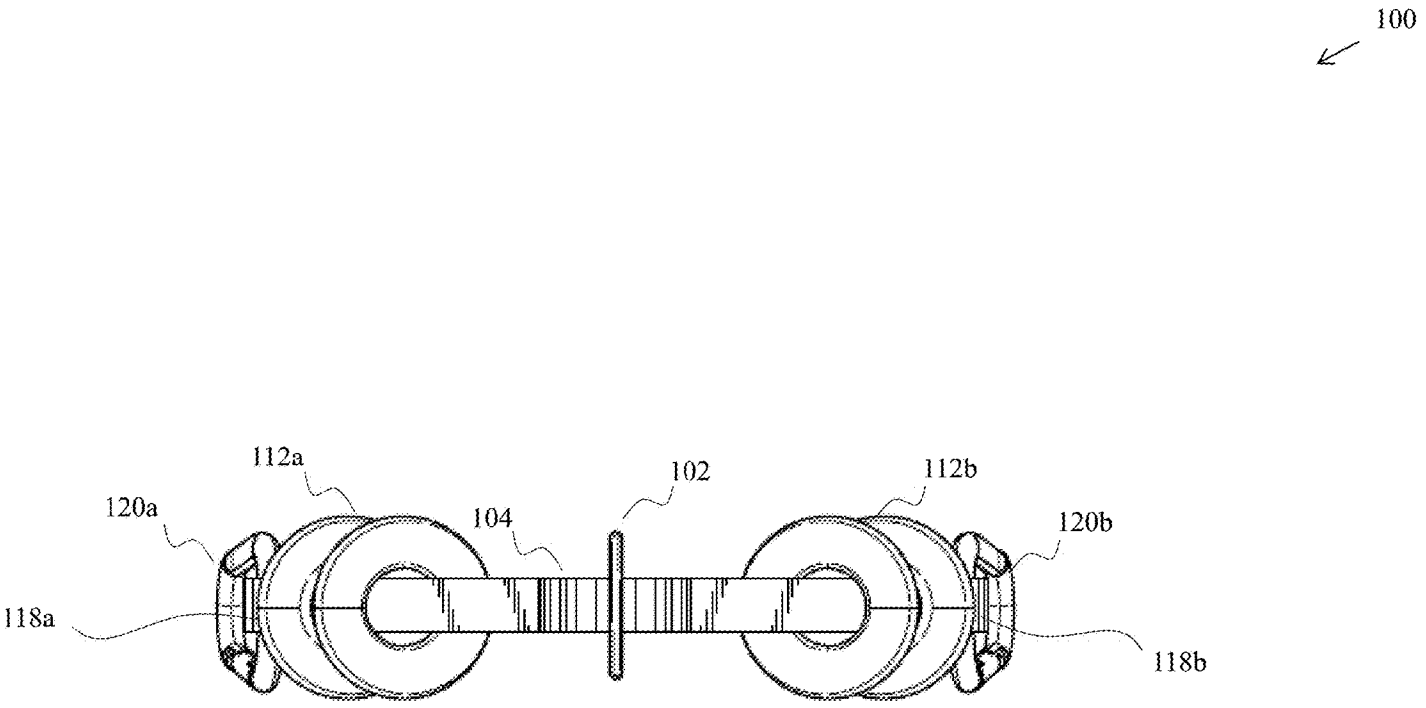
FIG. 2A illustrates a top view of an example embodiment of the universal workout handle with adjustable hand grip orientations according to the present disclosure.
Figure 2B:
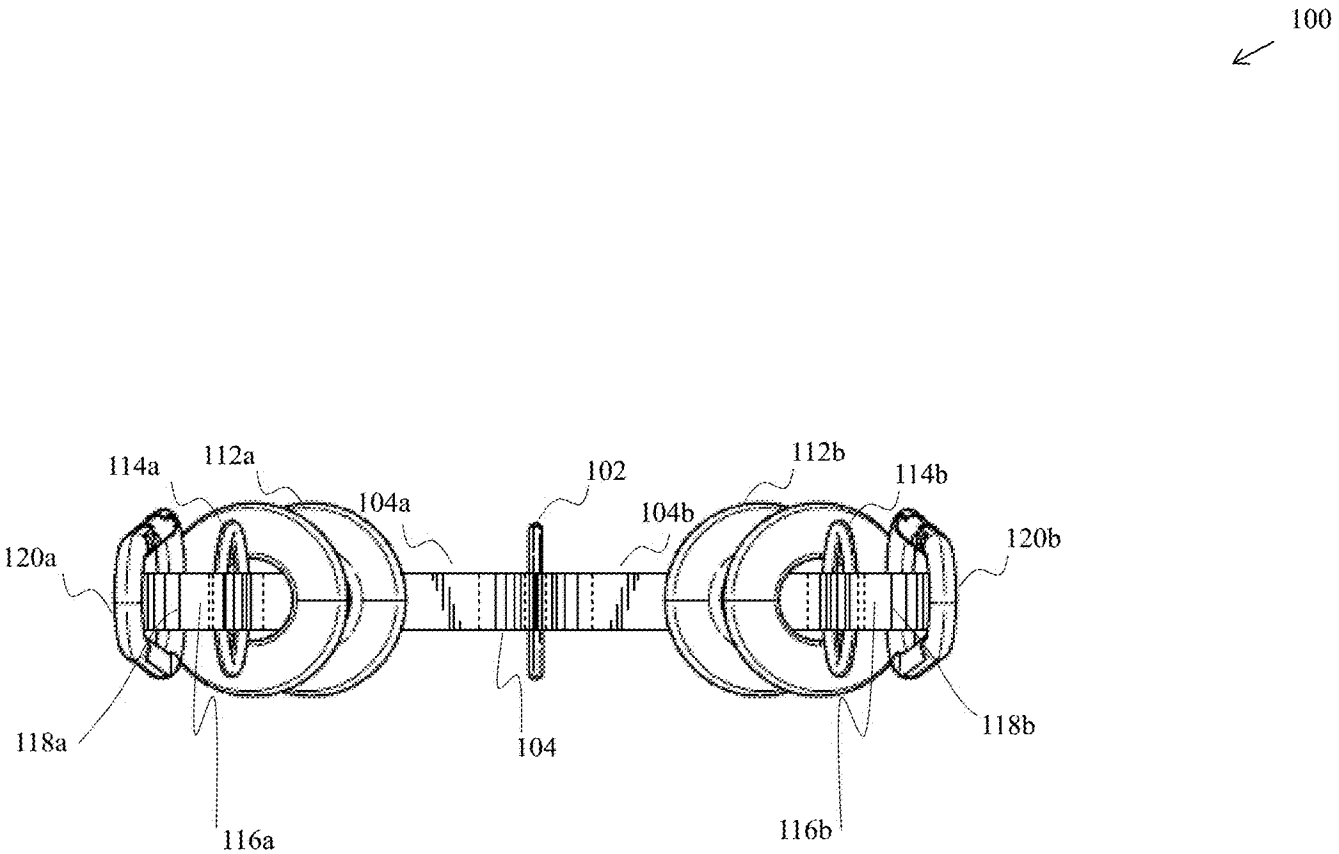
FIG. 2B illustrates a bottom view of an example embodiment of the universal workout handle with adjustable hand grip orientations according to the present disclosure.

FIGS. 1B-1C show a clear view of the attached carabiner clips. Changing the configuration of this workout handle between its vertical and horizontal orientations is as simple as fastening or unfastening the attached carabiner to the loop at the top of handle, which only takes seconds to do (shown clearly in FIG. 3). Typically, an individual would have to pause their workouts to locate a different cable machine handle attachment to exercise different muscles. Depending on the scope of the muscles being targeted during a user's workout, they might have to swap the cable machine attachments multiple times. This results in time being wasted searching a gym for the different attachments, waiting for an attachment to become available, and securing the different attachment to the cable machine. The construction of the workout handle in this application streamlines cable machine workouts, allowing users to target all major upper body muscle groups seamlessly without the inconvenience of changing attachments for different upper body exercises, thus enhancing the efficiency and user experience of weightlifting and strength training. The carabiner clip shown in one embodiment can bear up to 200 pounds, thus when weight is equally distributed through both lengths of the handle (one in each hand), up to 400 pounds can be lifted in total. The specific carabiner can be changed by the user to allow for greater load bearing ability as the user sees fit.

The strap used in production of the workout handle is preferably of sufficient thickness and durability to ensure a reasonable amount of weight bearing ability. In the present embodiment shown in FIGS. 1A-1C and FIG. 3, the strap is illustratively comprised of a nylon fabric that can bear up to 1,500 pounds. Since the fabric has been folded over itself once, thus doubling its thickness, its bearable load is increased to 3,000 pounds. The strap material can be comprised of this nylon fabric, or other suitable material known in the art.

As will also be appreciated, the above examples are intended only for the understanding of certain aspects of the techniques herein and are not limiting in nature. While the techniques are described primarily with respect to a universal workout handle attachment, the disclosed embodiments may be configured with other devices and/or attachments according to further implementations. Also, while a certain orientation of the carabiner clips are shown, other arrangements may be made, such as attaching the clips to loop 108*a* and loop 108*b*, therefore allowing loop 118*a* and loop 118*b* to be the loops a user would then attach to their respective carabiner clips to adjust the orientation of the workout handle. Also, while carabiner clips are shown, other similarly functional clips, hooks, or attachment mechanisms may be used, accordingly.

The universal workout handle with adjustable hand grip orientations represents a significant leap forward in cable machine exercise equipment, surpassing pre-existing handles in its versatility and user convenience. By consolidating the functionality of various traditional attachments into one, it eliminates the need for constant handle changes during workouts, saving time and reducing interruptions. With its adaptable design and ergonomic hand grips, it enhances muscle control and provides an efficient means to target all major upper body muscle groups, while reducing the risk of causing pain or injury to a user's hands and wrists. This innovative handle not only simplifies cable machine workouts but also enriches the user experience, making it a superior choice for fitness enthusiasts seeking a more effective and seamless approach to their upper body training routines.

According to one or more embodiments of the present disclosure as described in greater detail above, a workout handle for use with a cable machine herein may illustratively comprise: a primary attachment ring configured for connection to a cable machine; a first strap doubled onto itself and passing through the primary attachment ring, the first strap doubled onto itself being folded over and sewn around the primary attachment ring to create a primary loop around the primary attachment ring and first and second individual portions of the first strap doubled onto itself; a respective repositioning loop formed within each of the first and second individual portions of the first strap doubled onto itself and below the primary loop; a respective hand grip on each of the first and second individual portions of the first strap doubled onto itself and below the respective repositioning loop, the respective hand grip oriented in a generally vertical alignment relative to being hung from the primary attachment ring; a respective stopper ring positioned below each respective hand grip and sewn into the first and second individual portions of the first strap doubled onto itself; and a respective secondary strap extending from each respective stopper ring and terminating in a respective clip loop, wherein a respective attachment mechanism connecting the respective clip loop of each respective secondary strap to the respective repositioning loop formed within each of the first and second individual portions of the first strap repositions the respective hand grip to be oriented as a stirrup handle in a generally horizontal alignment relative to being hung from the primary attachment ring.

In one embodiment, the respective hand grip on each of the first and second individual portions are constructed of plastic.

In one embodiment, the respective hand grip on each of the first and second individual portions comprise a passthrough aperture through which pass the first and second individual portions of the first strap.

In one embodiment, the workout handle may further comprise: a respective attachment mechanism within the respective clip loop of each respective secondary strap. In one embodiment, the respective attachment mechanism within the respective clip loop of each respective secondary strap is a quick-release attachment mechanism. In one embodiment, the respective attachment mechanism within the respective clip loop of each respective secondary strap is a carabiner clip.

In one embodiment, the respective clip loop of each respective secondary strap is configured to allow interchangeable attachment of exercise equipment.

In one embodiment, the respective attachment mechanism within the respective clip loop of each respective secondary strap is a carabiner clip.

In one embodiment, the respective repositioning loop formed within each of the first and second individual portions of the first strap doubled onto itself are formed by not sewing the first strap doubled onto itself at a location of the respective repositioning loop formed within each of the first and second individual portions.

In one embodiment, the first strap comprises a nylon strap.

The foregoing description has been directed to specific embodiments. It will be apparent, however, that other variations and modifications may be made to the described embodiments, with the attainment of some or all of their advantages. Accordingly, this description is to be taken only by way of example and not to otherwise limit the scope of the embodiments herein. Therefore, it is the object of the appended claims to cover all such variations and modifications as come within the true spirit and scope of the embodiments herein.

What is claimed is:

1. A workout handle for use with a cable machine, the workout handle comprising:

a primary attachment ring configured for connection to a cable machine;

a first strap doubled onto itself and passing through the primary attachment ring, the first strap doubled onto itself being folded over and sewn around the primary attachment ring to create a primary loop around the primary attachment ring and first and second individual portions of the first strap doubled onto itself;

a respective repositioning loop formed within each of the first and second individual portions of the first strap doubled onto itself and below the primary loop;

a respective hand grip on each of the first and second individual portions of the first strap doubled onto itself and below the respective repositioning loop, the respective hand grip oriented in a generally vertical alignment relative to being hung from the primary attachment ring;

a respective stopper ring positioned below each respective hand grip and sewn into the first and second individual portions of the first strap doubled onto itself; and a respective secondary strap extending from each respective stopper ring and terminating in a respective clip loop, wherein a respective attachment mechanism connecting the respective clip loop of each respective secondary strap to the respective repositioning loop formed within each of the first and second individual portions of the first strap repositions the respective hand grip to be oriented as a stirrup handle in a generally horizontal alignment relative to being hung from the primary attachment ring.

2. The workout handle as in claim 1, wherein the respective hand grip on each of the first and second individual portions are constructed of plastic.

3. The workout handle as in claim 1, wherein the respective hand grip on each of the first and second individual portions comprise a passthrough aperture through which pass the first and second individual portions of the first strap.

4. The workout handle as in claim 1, further comprising:

a respective attachment mechanism within the respective clip loop of each respective secondary strap.

5. The workout handle as in claim 4, wherein the respective attachment mechanism within the respective clip loop of each respective secondary strap is a quick-release attachment mechanism.

6. The workout handle as in claim 4, wherein the respective attachment mechanism within the respective clip loop of each respective secondary strap is a carabiner clip.

7. The workout handle as in claim 1, wherein the respective clip loop of each respective secondary strap is configured to allow interchangeable attachment of exercise equipment.

8. The workout handle as in claim 1, wherein the respective attachment mechanism within the respective clip loop of each respective secondary strap is a carabiner clip.

9. The workout handle as in claim 1, wherein the respective repositioning loop formed within each of the first and second individual portions of the first strap doubled onto itself are formed by not sewing the first strap doubled onto itself at a location of the respective repositioning loop formed within each of the first and second individual portions.

10. The workout handle as in claim 1, wherein the first strap comprises a nylon strap.

* * * * *